United States Patent [19]

Augsburger

[11] 4,194,468

[45] Mar. 25, 1980

[54] FORCED-FLOW BOILER INSTALLATION AND METHOD OF OPERATING THE SAME

[75] Inventor: Walter Augsburger, Hettlingen, Switzerland

[73] Assignee: Sulzer Brothers Limited, Winterthur, Switzerland

[21] Appl. No.: 936,944

[22] Filed: Aug. 25, 1978

[30] Foreign Application Priority Data

Sep. 2, 1977 [CH] Switzerland ..... 10719/77

[51] Int. Cl.[2] ..... F22B 35/14

[52] U.S. Cl. ..... 122/406 ST; 122/451 R

[58] Field of Search ..... 122/406 R, 406 S, 406 ST, 122/451, 451 S

[56] References Cited

U.S. PATENT DOCUMENTS

| | | | |
|---|---|---|---|
| 3,038,453 | 6/1962 | Armacost | 122/406 ST |
| 3,212,477 | 10/1965 | Gerber et al. | 122/406 ST |
| 3,411,484 | 11/1968 | Kraus | 122/406 ST |

*Primary Examiner*—Edward G. Favors

*Attorney, Agent, or Firm*—Werner W. Kleeman

[57] ABSTRACT

A forced-flow boiler installation and method of operating the same comprising a series circuit of a feed pump, an economizer, an evaporator and a water separator as well as a recirculation line or system containing therein a circulating pump and leading from the water outlet of the separator to the evaporator inlet. Between the feed pump and a subsequently connected closure valve there branches-off a filling line or conduit having a valve and bypassing the economizer and leading to the evaporator inlet. The economizer, at the region of its maximum geodetic height, contains venting means.

7 Claims, 1 Drawing Figure

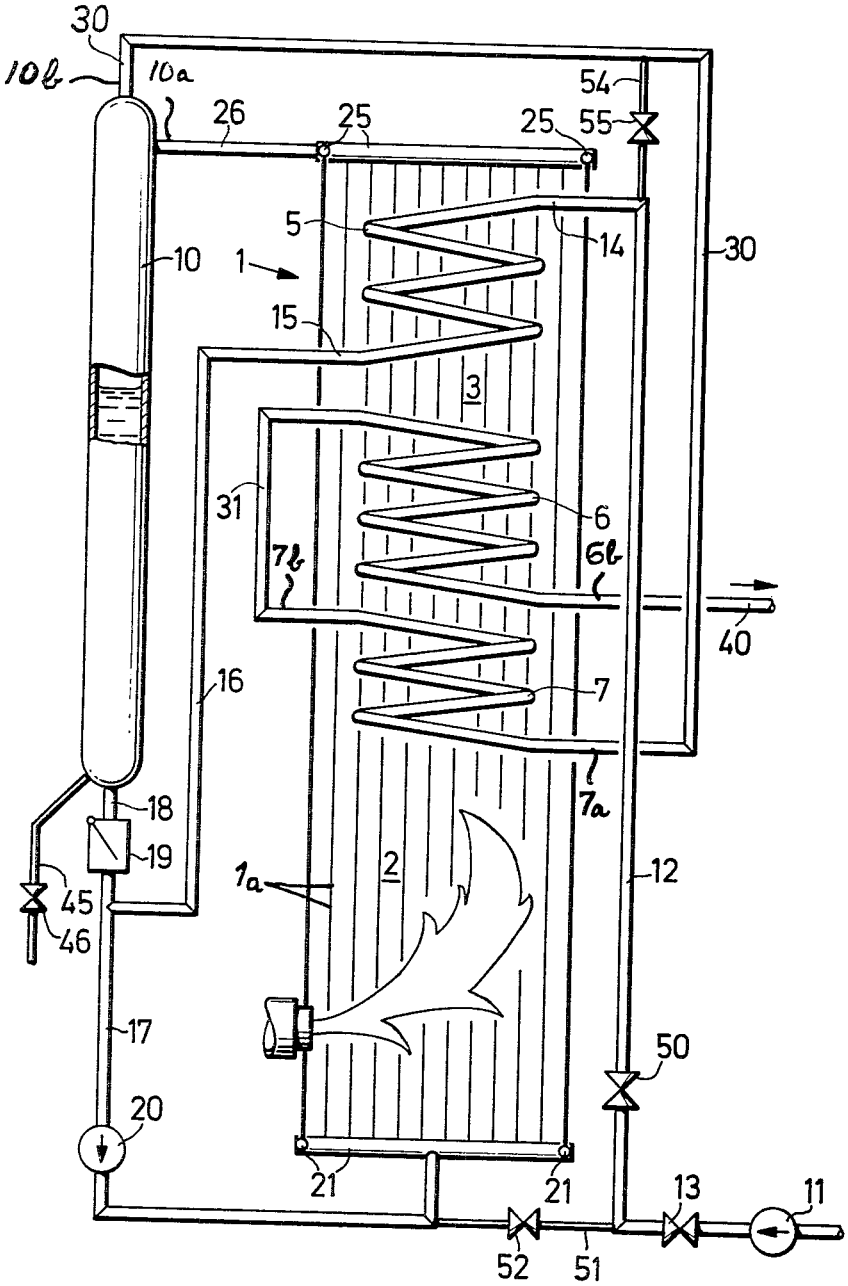
30
10b
10a
26
25
25
54
55
5
14
30
10
1
15
3
31
6
7b
6b
40
16
7
7a
18
19
1a
2
12
45
46
17
50
20
21
21
13
11
52
51

FORCED-FLOW BOILER INSTALLATION AND METHOD OF OPERATING THE SAME

BACKGROUND OF THE INVENTION

The present invention relates to a new and improved construction of forced-flow boiler installation comprising a series connection of a feed pump, an economizer, an evaporator, and a water separator as well as a recirculation line or system having arranged therein a circulation pump and leading from the water outlet of the separator to the evaporator inlet. The invention further relates to a novel method of placing into operation such forced-flow-type boiler installation.

With such type boiler installations, especially if the boiler is designed in a tower type construction, so that the economizer is located geodetically high in relation to the evaporator, there results the problem that upon hot shutdown of the boiler the water in the economizer vaporizes, and thus, during rapid restarting by infeeding cold feed water into the still hot economizer there arises spontaneous condensation which is associated with pronounced pounding or impacts.

To reduce such pounding it is conventional to wait with the restarting of the boiler until the economizer has efficiently cooled. To shorten the cooling times the boiler can be vented. Due to these measures there is not only consumed energy for the drive of the ventilator or fan, but furthermore heat is lost to the surroundings.

SUMMARY OF THE INVENTION

Therefore, with the foregoing in mind, it is a primary object of the present invention to avoid, upon restarting of such forced-flow-type boiler installations, the occurrence of the condensation pounding or impacts, and furthermore, to accelerate the restarting operation and to render such more economical.

A further object of the present invention aims at providing a novel method of operating such forced-flow-type boiler installation with improved economy and in a more protective manner.

Now, in order to implement these and still further objects of the invention which will become more readily apparent as the description proceeds, the invention contemplates arranging a filling line having a valve which branches-off between the feed pump and a subsequently connected closure valve, the filling line leading to the inlet of the evaporator and bypassing the economizer. Further the economizer is provided at the region of its maximum geodetic height with means for venting.

As already mentioned above, the invention also relates to a novel method for placing into operation a forced-flow boiler installation while still in a hot condition or state. This method resides in filling the evaporator and separator by means of the filling line with feedwater, thereafter, with the economizer essentially filled with vapor, water is recirculated from the evaporator through the separator to the evaporator, the boiler is fired and then the economizer is rearwardly filled from the evaporator with water substantially at the saturation temperature, if desired, while further supplying the evaporator by means of the filling line before there is turned-on the normal forced-flow through the economizer and evaporator.

After hot shutdown of the system the evaporator and separator of the heretofore discussed forced-flow-type boiler installation generally only still receive so little water that upon turning-on the circulating pump the water separator is sucked empty and thus there is lost the infeed height or water column needed for this pump. This is now counteracted by the water infeed to the evaporator until such overflows and there has been regulated in the separator the water level required for the circulation or circulating pump.

Now if with the circulation pump in operation the boiler is fired, then the water temperature successively rises at the boiler part affected by the circulation until after a short period of time there is produced in the evaporator steam or vapor, and by means of such steam there is ejected the water from the evaporator into the water separator. Consequently, the water level in the separator rises, whereas the pressure of the steam or vapor cushion in the economizer prevents the penetration of water therein. Now, if the vent line or conduit is opened, the water ascends out of the separator into the economizer. Since this water is at approximately saturation temperature there does not occur any appreciable condensation. As a result, condensation pounding or knocking phenomenon is thus prevented.

Depending upon the disposition of the installation it can be advantageous after the initial ejection of water out of the evaporator to lower the water level in the separator to a minimum permissible value, while taking into consideration the operating characteristics of the circulation pump, prior to venting the economizer. By virtue of this measure there is realized the advantage that any colder water plug or mass possibly present in the connection line or conduit between the economizer outlet and the separator is at least partially removed.

BRIEF DESCRIPTION OF THE DRAWINGS

The invention will be better understood and objects other than those set forth above, will become apparent when consideration is given to the following detailed description thereof. Such description makes reference to the annexed drawing wherein the single FIGURE schematically illustrates an exemplary embodiment of forced-flow-type boiler installation constructed according to the teachings of the present invention.

DETAILED DESCRIPTION OF THE PREFERRED EMBODIMENTS

Describing now the drawing, the forced-flow boiler installation shown therein will be seen to comprise an evaporator 1 formed of substantially parallel, gas-tightly welded together tubes 1*a* which form the walls of a combustion chamber or compartment 2 and a flue gas pass or draft 3. In the flue gas pass or draft 3 there are arranged, viewed from the top towards the bottom of the showing of the exemplary embodiment of boiler installation, an economizer 5, an end or terminal superheater 6 and pre-superheater 7. Externally of the flue gas pass 3 there is provided a water separator 10. A feed or supply line 12 having a feed or supply regulation valve 13 leads from a feed pump 11 to the inlet 14 of the economizer 5 which is arranged high in the flue gas pass or draft 3. The outlet 15 of the economizer 5 is connected by means of a line or conduit 16 with a circulation line or conduit 17 leading from the water outlet 18 of the water separator 10 by means of a check valve 19 and a circulation pump 20 to the inlet distributor 21 of the evaporator 1. Outlet or exit collectors 25 of the evaporator 1 are connected by means of a line or conduit 26 with the mixture inlet 10*a* of the water separator 10. A saturation vapor or steam line 30 leads from the vapor or steam outlet 10*b* of the water separator 10 to the inlet 7*a* of the pre-superheater 7. A line or conduit 31 interconnects the outlet 7*b* of the pre-superheater 7 with the inlet 6*a* of the end-superheater 6 and a live vapor line or conduit 40 leads from the outlet 6*b* of the end-superheater 6 to a not particularly illustrated steam consumer. The water separator 10 can be provided, parallel to the circulation line or conduit 17, with a withdrawal line 45 having a valve 46. The installation described up to this point is of conventional design.

Now if such type forced-flow boiler installation is turned-off, then the economizer 5, which following the shutdown is still located in an extremely hot part of the boiler installation, is filled with vapor. If after a short shutdown time the system is again placed into operation and feedwater is delivered into the economizer 5 then there spontaneously occurs condensation which is associated with extremely hard pounding or knocking phenomenon which can lead to damage of the boiler.

The described, conventional installation therefore, according to the invention, is augmented by a filling line or conduit 51 which branches-off between the feed pump 11 and a subsequently connected closure or shut-off valve 50. This filling line or conduit 51 bypasses the economizer 5 and leads to the inlet distributor 21 of the evaporator 1. The filling line or conduit 51 is equipped with a valve 52 and the installation is provided with means which enables venting of the economizer 5, such venting means comprising a connection line or conduit 54 having a valve 55. The connection line 54 branches-off of the supply line 12 at the region of the economizer inlet 14 and leads to the saturated vapor or steam line 30.

The thus augmented forced-flow boiler installation is started in the following manner: After the hot shutdown of the boiler or boiler installation the economizer 5 contains steam which usually is in a superheated state. The evaporator 1 and separator 10 contain a great deal of steam and little water.

Now for the hot start-up of the boiler installation the feed pump 11, with the closure valve 50 closed, is placed into operation and the valve 52 is opened, so that the feed water flows via the inlet distributor 21 into the evaporator 1 and partially condenses the vapor present therein and partially forces such into the remaining heating surfaces. The water level in the evaporator 1 climbs until the water overflows out of the evaporator 1 by means of the line or conduit 26 into the water separator 10. In the water separator 10 the level climbs. Penetration of water into the economizer 5 is prevented by means of the therein prevailing steam or vapor cushion. After there has been reached in the water separator 10 a water level or column which is sufficiently high for the positive functioning of the circulation pump 20 the latter is then turned-on and there is initiated boiler firing. The temperature of the water fed by the circulation pump 20 successively increases until after a short period of time there occurs steam or vapor formation in the evaporator 1, resulting in the ejection of water out of the evaporator 1 into the separator 10. Now the vent valve 55 is opened, so that the economizer 5 and separator 10 in effect become vessels which flow communicate with one another at their upper and lower regions or ends and the water rises rearwardly via the line 16 in the economizer 5. Since the water practically is at the saturation vapor temperature the condensation in the economizer is not appreciable, so that there is supressed the feared pounding or knocking.

Due to the further feeding which is accommodated to the firing capacity of the boiler, by means of the valve 52, there is now further raised the level within the separator 10 and economizer 5 until the latter is full. Now the valves 52 and 55 are closed and the valve 50 is open, so that the boiler is prepared for carrying out the further conventional starting-up operation which can encompass the regulation of the heat and water infeed, the boiler pressure and, for instance, switching of possibly available low-pressure heating surfaces which are not particularly shown in the drawing.

The described improved construction of forced-flow type boiler installation also can be employed for energy-saving starting from a cold state, since it enables, likewise starting from an empty economizer, taking-up the water ejected out of the evaporator, which otherwise, since it does not have any place in the separator, for the most part must be drawn-off.

If the feed pump 11 is appropriately regulatable and if the feed valve 13 can be tightly shut off, then the same, instead of being arranged at the indicated location, also can be arranged in place of the closure valve 50 and assume its function.

While there are shown and described present preferred embodiments of the invention, it is to be distinctly understood that the invention is not limited thereto, but may be otherwise variously embodied and practiced with the scope of the following claims.

What I claim is:

1. A forced-flow type boiler installation comprising:
- a feed pump;
- an economizer;
- an evaporator;
- a water separator;
- said feed pump, economizer, evaporator and water separator being connected in series;
- said separator having a water outlet and said evaporator having an inlet;
- a circulation line means having a circulation pump leading from the water outlet of the separator to the inlet of the evaporator;
- filling line means having a valve;
- a closure valve connected following the feed pump;
- said filling line means branching-off between the feed pump and the closure valve connected following the feed pump;
- said filling line means bypassing the economizer and leading to the inlet of the evaporator; and
- means for venting the economizer at the region of its maximum geodetic height.

2. The forced-flow boiler installation as defined in claim 1, further including:
- saturation vapor line means branching-off of the water separator; and
- said venting means comprising a line having valve means and opening into said saturation vapor line means branching-off of the water separator.

3. The forced-flow boiler installation as defined in claim 2, wherein:
- said closure valve simultaneously constitutes a feed-regulation valve.

4. The forced-flow boiler installation as defined in claim 1, wherein:
- said water separator has a lower region; and
- A withdrawal line having valve means provided for the lower region of the water separator.

5. A method of placing into operation a forced-flow boiler installation, particularly for hot start-up of such boiler installation following shutdown thereof, comprising the steps of:

providing a series circuit of a feed pump, an economiser, an evaporator and a water separator;

providing a circulation line with a circulation pump and leading from a water outlet of the separator to an inlet of the evaporator;

during normal forced-flow of the boiler installation infeeding feedwater by means of said feed pump to the economiser, evaporator and water separator;

following shutdown of the boiler installation and hot start-up thereof carrying out the steps of:

infeeding feedwater to the evaporator and separator by means of a filling line;

then when the economiser is filled with steam recirculating water out of the evaporator via the separator and the circulation line into the evaporator by means of the circulation pump;

firing the boiler; and then filling the economiser rearwardly out of the evaporator with water approximately at saturated temperature before there is again initiated the normal forced-flow through the economiser and the evaporator.

6. The method as defined in claim 5, wherein:

said rearward filling of the economizer with water is accomplished while infeeding feedwater to the evaporator by means of the filling line.

7. The method as defined in claim 5, further including the steps of:

providing means for venting the economizer; and directly prior to actuating the means for venting the economizer briefly bringing the water level in the separator to a height which is essentially at a minimum in consideration of the operating characteristics of said circulation pump.

* * * * *